US008174251B2

(12) United States Patent
Kimura

(10) Patent No.: US 8,174,251 B2
(45) Date of Patent: May 8, 2012

(54) SERIES REGULATOR WITH OVER CURRENT PROTECTION CIRCUIT

(75) Inventor: Hiroyuki Kimura, Sendai (JP)

(73) Assignee: Freescale Semiconductor, Inc., Austin, TX (US)

( * ) Notice: Subject to any disclaimer, the term of this patent is extended or adjusted under 35 U.S.C. 154(b) by 375 days.

(21) Appl. No.: 12/504,653

(22) Filed: Jul. 16, 2009

(65) Prior Publication Data

US 2009/0273323 A1 Nov. 5, 2009

Related U.S. Application Data

(63) Continuation-in-part of application No. 11/854,546, filed on Sep. 13, 2007, now Pat. No. 7,786,713.

(51) Int. Cl.
*G05F 1/00* (2006.01)

(52) U.S. Cl. ..... 323/273; 323/275; 323/276

(58) Field of Classification Search ..... 323/269–270, 323/273–281, 224, 226, 293, 298, 353
See application file for complete search history.

(56) References Cited

U.S. PATENT DOCUMENTS

| | | | | |
|---|---|---|---|---|
| 3,723,774 | A * | 3/1973 | Rogers | 323/277 |
| 4,005,353 | A | 1/1977 | Yokoyama | |
| 4,282,477 | A | 8/1981 | Ahmed | |
| 4,531,173 | A | 7/1985 | Yamada | |
| 5,208,718 | A | 5/1993 | Fox | |
| 5,550,462 | A | 8/1996 | Nakajima | |
| 5,675,240 | A | 10/1997 | Fujisawa et al. | |
| 6,005,378 | A | 12/1999 | D'Angelo et al. | |
| 6,160,490 | A | 12/2000 | Pace | |
| 6,340,878 | B1 | 1/2002 | Oglesbee | |
| 6,541,946 | B1 | 4/2003 | Chen | |
| 6,690,147 | B2 | 2/2004 | Bonto | |
| 6,703,815 | B2 * | 3/2004 | Biagi | 323/280 |
| 6,861,827 | B1 | 3/2005 | Yang | |
| 6,952,091 | B2 * | 10/2005 | Bansal | 323/277 |
| 6,960,907 | B2 | 11/2005 | Poss | |
| 6,965,223 | B1 | 11/2005 | MacLean | |
| 6,967,470 | B2 | 11/2005 | Takabayashi | |
| 6,989,659 | B2 | 1/2006 | Menegoli | |
| 7,042,280 | B1 | 5/2006 | Huang et al. | |
| 7,081,742 | B2 * | 7/2006 | Ito et al. | 323/273 |
| 7,091,710 | B2 | 8/2006 | Yang | |
| 7,129,686 | B1 | 10/2006 | Huang | |
| 7,173,401 | B1 | 2/2007 | Huang | |
| 7,176,668 | B2 | 2/2007 | Oswald | |

(Continued)

FOREIGN PATENT DOCUMENTS

JP 5-326679 A 12/1993

(Continued)

*Primary Examiner* — Jue Zhang
(74) *Attorney, Agent, or Firm* — Charles Bergere

(57) ABSTRACT

A series regulator with an over current protection circuit regulates output current by controlling an output transistor. A current sense transistor output depends on the conductivity of the output transistor. A current limiting transistor controls the conductivity of the output transistor. A current supply provides current to a constant current source and a converter output of a current to voltage converter. The converter output is connected to a control electrode of the current limiting transistor. A first differential transistor couples the current sense transistor to the constant current source and a second differential transistor couples the current supply to the constant current source. The current sense transistor controls the second differential transistor to vary a control current. When the control current matches a threshold value, the current limiting transistor limits maximum current flow through the output transistor.

20 Claims, 7 Drawing Sheets

U.S. PATENT DOCUMENTS

| | | | | |
|---|---|---|---|---|
| 7,221,132 | B2 | 5/2007 | Okubo | |
| 7,224,156 | B2 | 5/2007 | Chen | |
| 7,245,115 | B2 | 7/2007 | Chilcote | |
| 7,339,775 | B2 | 3/2008 | Kimura | |
| 7,405,546 | B2 | 7/2008 | Amrani | |
| 7,411,376 | B2 | 8/2008 | Zhang | |
| 7,414,384 | B2 | 8/2008 | Kimura | |
| 7,420,356 | B2 | 9/2008 | Hojo | |
| 7,755,337 | B2 * | 7/2010 | Negoro | 323/277 |
| 2003/0214275 | A1 * | 11/2003 | Biagi | 323/280 |
| 2004/0178778 | A1 * | 9/2004 | Bansal | 323/274 |
| 2006/0133000 | A1 * | 6/2006 | Kimura | 361/93.1 |
| 2007/0018621 | A1 | 1/2007 | Mok et al. | |
| 2007/0182399 | A1 | 8/2007 | Enjalbert | |
| 2007/0222425 | A1 * | 9/2007 | Kimura | 323/315 |
| 2008/0048626 | A1 * | 2/2008 | Kimura | 323/271 |
| 2008/0191671 | A1 | 8/2008 | Shikata | |
| 2008/0191673 | A1 * | 8/2008 | Kimura | 323/280 |
| 2008/0208513 | A1 | 8/2008 | Depuy et al. | |
| 2008/0218223 | A1 | 9/2008 | Kimura | |
| 2008/0225456 | A1 | 9/2008 | Daio et al. | |
| 2008/0258691 | A1 | 10/2008 | Lai et al. | |
| 2008/0258696 | A1 * | 10/2008 | Kimura | 323/269 |

FOREIGN PATENT DOCUMENTS

| | | | |
|---|---|---|---|
| JP | 6311734 | A | 11/1994 |
| JP | 7-182055 | A | 7/1995 |
| JP | 9-262540 | A | 3/1996 |
| JP | 9265330 | A | 10/1997 |
| JP | 10257686 | A | 9/1998 |
| JP | 11-103524 | A | 4/1999 |
| JP | 2000031807 | A | 1/2000 |
| JP | 2000339962 | A | 12/2000 |
| JP | 2001117650 | A | 4/2001 |
| JP | 2001-216034 | | 8/2001 |
| JP | 2001292054 | A | 10/2001 |
| JP | 2002-83494 | | 3/2002 |
| JP | 2002169618 | A | 6/2002 |
| JP | 2002312043 | A | 10/2002 |
| JP | 2002343874 | A | 11/2002 |
| JP | 2003029856 | A | 1/2003 |
| JP | 2003177829 | A | 6/2003 |
| JP | 2003216252 | A | 7/2003 |
| JP | 2003224968 | A | 8/2003 |
| JP | 2004062374 | A | 2/2004 |
| JP | 2005011280 | A | 1/2005 |
| JP | 2005190381 | A | 7/2005 |
| JP | 2005327164 | A | 11/2005 |
| JP | 2005333691 | A | 12/2005 |
| JP | 2006-190021 | | 7/2006 |
| JP | 2007004581 | A | 1/2007 |
| JP | 2008112251 | A | 5/2008 |

* cited by examiner

SERIES REGULATOR WITH OVER CURRENT PROTECTION CIRCUIT

This application is a continuation-in-part of prior U.S. application Ser. No. 11/854,546 filed on Sep. 13, 2009 now U.S. Pat. No. 7,786,713.

BACKGROUND OF THE INVENTION

The present invention relates to a series regulator and more particularly to a series regulator that has an over current protection circuit.

Series regulators are used in electronic circuits and devices to provide a relatively stable DC (Direct Current) output voltage with limited fluctuation to a large variation in load current. Such regulators are also known as Low Drop Out (LDO) regulators. Typically, LDO regulators rely on a feedback voltage to maintain a constant output voltage. More specifically, an error signal whose value is a function of the difference between the feedback voltage (proportional to the actual output voltage) and a nominal value is amplified and used to control current flow through a pass device such as a power transistor, from the power supply to the load. LDOs are especially beneficial for limiting unnecessary supply power drain in portable battery-powered devices such as cameras, laptop computers, cellular telephones, personal digital assistants and handheld entertainment devices.

Over-current protection is typically required when unusually low resistances or a short-circuit condition occurs in the output of a regulator circuit. Over-current protection can be achieved by employing a circuit that monitors the current delivered to a load and then clamping the current when it exceeds a predetermined maximum level. Such circuits may require floating currents or at least one reference current that is greater than the bias current of the rest of the regulator.

For small, battery-powered devices, it is important to conserve the charge in the battery. Thus, there is a need for a series regulator that does not require large reference currents or a have floating current, and can limit current drain when at or near a short circuit load condition.

BRIEF DESCRIPTION OF THE DRAWINGS

The invention, together with objects and advantages thereof, may best be understood by reference to the following description of preferred embodiments together with the accompanying drawings in which.

DETAILED DESCRIPTION OF PREFERRED EMBODIMENTS

Figure 1:
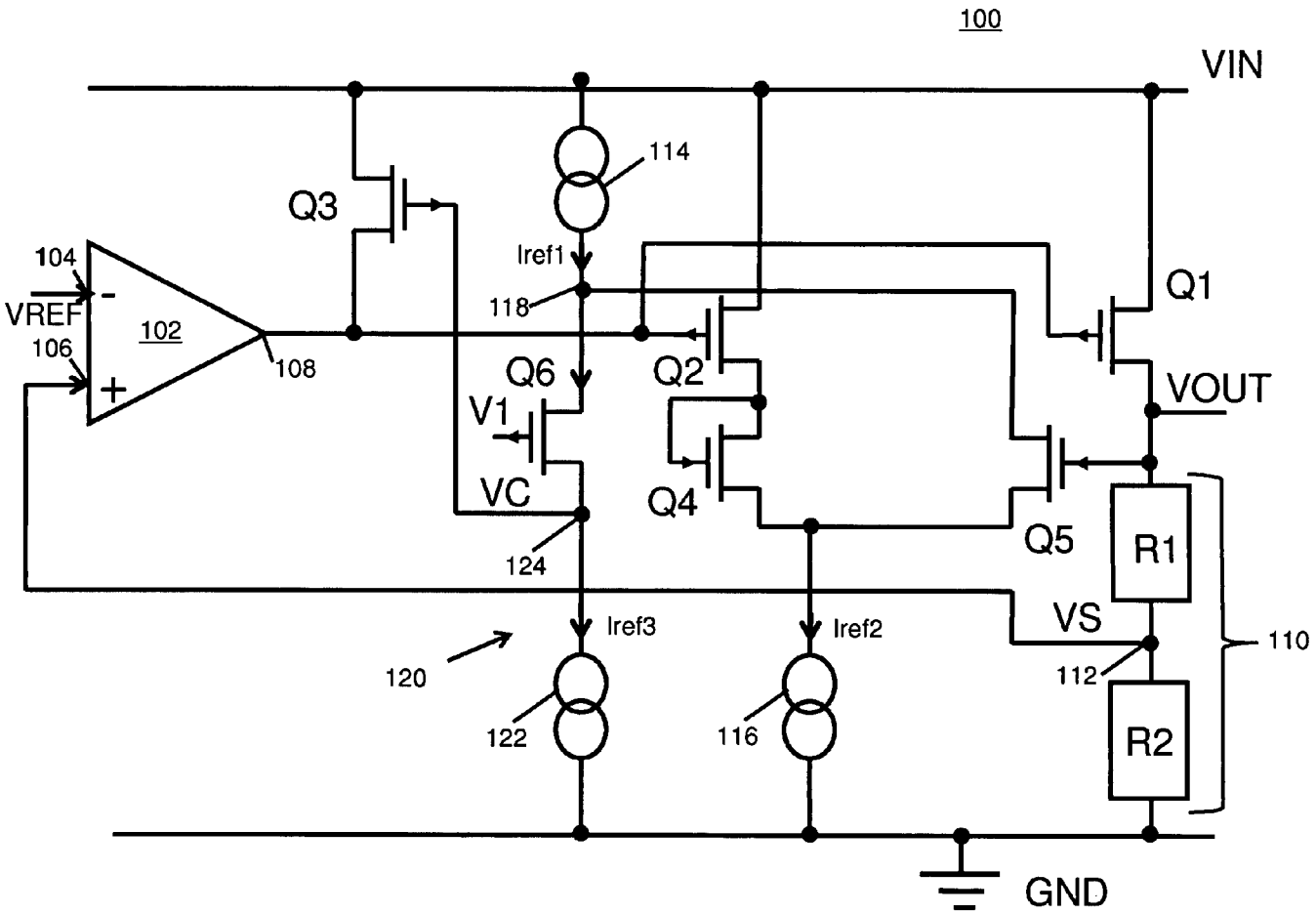
FIG. 1 is a schematic circuit diagram of a series regulator with an over current protection circuit in accordance with an embodiment of the present invention.

The detailed description set forth below in connection with the appended drawings is intended as a description of presently preferred embodiments of the invention, and is not intended to represent the only forms in which the present invention may be practiced. It is to be understood that the same or equivalent functions may be accomplished by different embodiments that are intended to be encompassed within the spirit and scope of the invention. In the drawings, like numerals are used to indicate like elements throughout. Furthermore, terms "comprises," "comprising," or any other variation thereof, are intended to cover a non-exclusive inclusion, such that device components that comprises a list of elements does not include only those elements but may include other elements not expressly listed or inherent to such device components. An element proceeded by "comprises . . . a" does not, without more constraints, preclude the existence of additional identical elements that comprises the element.

In one embodiment, the present invention provides a series regulator with an over current protection circuit, wherein the series regulator receives an input voltage at an input power supply terminal and generates an output voltage and an output current at an output terminal. The series regulator has a differential amplifier with an inverting input that receives a reference voltage, a non-inverting input, and a differential amplifier output. An output transistor is connected between the input power supply terminal and the output terminal and a control electrode of the output transistor is connected to the differential amplifier output. There is a current sense transistor with a source electrode connected to the input power supply terminal and a control electrode connected to the differential amplifier output, wherein the conductivity of the current sense transistor is dependent on the conductivity of the output transistor.

The series regulator has a current limiting transistor connected between the input power supply terminal and the differential amplifier output. An attenuator circuit is connected between the output terminal and a power supply reference terminal. The attenuator circuit has an attenuator output connected to the non-inverting input of the differential amplifier, and the attenuator output provides a voltage signal proportional to the output voltage at the output terminal. There is a first constant current source connected to the input power supply terminal and a second constant current source connected to the power supply reference terminal.

The series regulator also further includes a differential transistor pair comprising a first differential transistor with a control electrode coupled to a drain electrode of the current sense transistor. The first differential transistor couples the current sense transistor to the second constant current source. The differential transistor pair has a second differential transistor with a control electrode coupled to the output terminal, and the second differential transistor couples an output of the first constant current source to the second constant current source. A current to voltage converter couples the output of first constant current source to the power supply reference terminal. The current to voltage converter has a converter output coupled to a control electrode of the current limiting transistor. In operation, the current sense transistor controls the conductivity of the second differential transistor thereby varying a control current supplied from the first constant current source to the current to voltage converter. When the control current matches a limiting threshold value, a voltage control signal at the converter output controls the current limiting transistor to thereby limit maximum current flow through the output transistor.

In another embodiment, the present invention provides a series regulator with an over current protection circuit, wherein the series regulator receives an input voltage at an input power supply terminal and generates an output voltage and an output current at an output terminal. The series regulator has a differential amplifier with an inverting input that receives a reference voltage, a non-inverting input, and a differential amplifier output. An output transistor is connected between the input power supply terminal and the output terminal and a control electrode of the output transistor is connected to the differential amplifier output. There is a current sense transistor with a source electrode connected to the input power supply terminal and a control electrode connected to the differential amplifier output, wherein the conductivity of the current sense transistor is dependent on the conductivity of the output transistor.

The series regulator also has a current limiting transistor connected between the input power supply terminal and the differential amplifier output. An attenuator circuit is connected between the output terminal and a power supply reference terminal. The attenuator circuit has an attenuator output connected to the non-inverting input of the differential amplifier, and the attenuator output provides a voltage signal proportional to the output voltage at the output terminal. There is a current mirror having an input connected to the input power supply terminal, the current mirror has two current supplying outputs.

The series regulator further includes a first constant current source with a first node connected to the power supply reference and a second constant current source. The second constant current source has a first node connected to the power supply reference terminal and a second node connected to both the first one of the current supplying outputs of the current mirror and the control electrode of the current limiting transistor.

There is a differential transistor pair comprising a first differential transistor with a control electrode coupled to a drain electrode of the current sense transistor. The first differential transistor couples the current sense transistor to the first constant current source. The differential transistor pair includes a second differential transistor with a control electrode coupled to the output terminal. The second differential transistor couples a second one of the two current supplying outputs of the current mirror to the second constant current source. In operation, the current sense transistor controls the conductivity of the second differential transistor thereby varying a control current supplied from the second one of the two current supplying outputs of the current mirror to the second constant current source. When the control current matches a limiting threshold value, a voltage control signal at the second one of the two current supplying outputs of the current mirror controls the current limiting transistor to thereby limit maximum current flow through the output transistor.

In yet another embodiment, the present invention provides a series regulator with an over current protection circuit, wherein the series regulator receives an input voltage at an input power supply terminal and generates an output voltage and an output current at an output terminal. The series regulator includes a differential amplifier having an inverting input that receives a reference voltage, a non-inverting input, and a differential amplifier output. There is an output transistor connected between the input power supply terminal and the output terminal, wherein a control electrode of the output transistor is connected to the differential amplifier output. There is a current sense transistor having a source electrode connected to the input power supply terminal, and a control electrode connected to the differential amplifier output. The conductivity of the current sense transistor is dependent on the conductivity of the output transistor.

The series regulator has a current limiting transistor connected between the input power supply terminal and the differential amplifier output. An attenuator circuit is connected between the output terminal and a power supply reference terminal. The attenuator circuit has an attenuator output connected to the non-inverting input of the differential amplifier, and the attenuator output provides a voltage signal proportional to the output voltage at the output terminal. There is a current supply source providing current to both a constant current source and a converter output of a current to voltage converter, and the converter output is connected to a control electrode of the current limiting transistor.

There is a differential transistor pair comprising a first differential transistor with a control electrode coupled to a drain electrode of the current sense transistor. The first differential transistor couples the current sense transistor to the constant current source. The differential transistor pair has a second differential transistor with a control electrode coupled to the output terminal, the second differential transistor couples the current supply source to the constant current source. In operation, the current sense transistor controls the conductivity of the second differential transistor thereby varying a control current supplied from the current supply source to the constant current source. When the control current matches a limiting threshold value, a voltage control signal at the converter output controls the current limiting transistor to thereby limit maximum current flow through the output transistor.

A series regulator with an over current protection circuit 100 in accordance with an embodiment of the present invention will now be discussed with reference to FIG. 1. In normal load operation the series regulator with an over current protection circuit 100 receives a input voltage VSUPP at an input power supply terminal VIN and generates an output voltage VO and an output or load current IOUT at an output terminal VOUT. The series regulator with an over current protection circuit 100 comprises a differential amplifier 102 having an inverting input 104 that receives a reference voltage VREF, a non-inverting input 106 and a differential amplifier output 108. An output transistor Q1 is connected between the input power supply terminal VIN and the output terminal VOUT, and a control electrode (gate) of the output transistor Q1 is connected to the differential amplifier output 108.

There is a current sense transistor Q2 with a source electrode connected to the input power supply terminal VIN, and a control electrode (gate) connected to the differential amplifier output 108. In operation, the conductivity of the current sense transistor Q2 is dependent on the conductivity of the output transistor Q1 and therefore current flow through the output transistor Q1 is proportional to current flow through the current sense transistor Q2. Typically, the output transistor Q1 conducts between 100 to 1,000 times more current than the current sense transistor Q2.

The series regulator with an over current protection circuit 100 also has current limiting transistor Q3 connected between the input power supply terminal VIN and the differential amplifier output 108. An attenuator circuit 110 is connected between the output terminal VOUT and a power supply reference terminal GND. In this embodiment, the power supply reference terminal GND is at ground potential, however, other potentials including both positive and negative potentials could also be used in other embodiments.

In this embodiment the attenuator circuit 110 is voltage divider with two series connected resistors R1,R2 (typically each being 10K Ohms in resistance) with a common node providing an attenuator output 112 connected to the non-inverting input 106 of the differential amplifier 102. In operation, the attenuator output 112 provides a voltage signal VS to the non-inverting input 106 that is proportional to the output voltage VO at the output terminal VOUT.

There is a first constant current source 114, associated with a constant current Iref1, connected to the input power supply terminal VIN and a second constant current source 116, associated with a constant current Iref2, is connected to the power supply reference terminal GND. There is a differential transistor pair comprising a first differential transistor Q4 and a second differential transistor Q5. A control electrode (gate) of the first differential transistor Q4 is coupled to a drain electrode of the current sense transistor Q2 and the first differential transistor Q4 couples the current sense transistor Q2 to the second constant current source 116. The second differential transistor Q5 has a control electrode (gate) coupled to the output terminal VOUT and the second differential transistor Q5 couples a current source output 118 of the first constant current source 114, supplying the constant current Iref1, to the second constant current source 116.

A current to voltage converter 120 couples the current source output 118 of the first constant current source 114 to the power supply reference terminal GND. The current to voltage converter 120 comprises a cascode transistor Q6 series coupled to a third constant current source 122 that has an associated constant current Iref3. The third constant current source 122 is connected to the power supply reference terminal GND and the drain of the cascode transistor Q6 is connected to the current source output 118 of the first constant current source 114. The cascode transistor Q6 is biased at a control electrode (gate) by a voltage V1 that is selected to be about 1.5 volts below the input voltage (supply voltage) VSUPP, and in operation, the cascade transistor Q6 has a low conductivity. The current to voltage converter 120 has a converter output 124 coupled to a control electrode (gate) of the current limiting transistor Q3. The converter output 124 generates a control signal VC and the converter output is provided by a common node of the cascode transistor Q6 and third constant current source 122.

Figure 2:
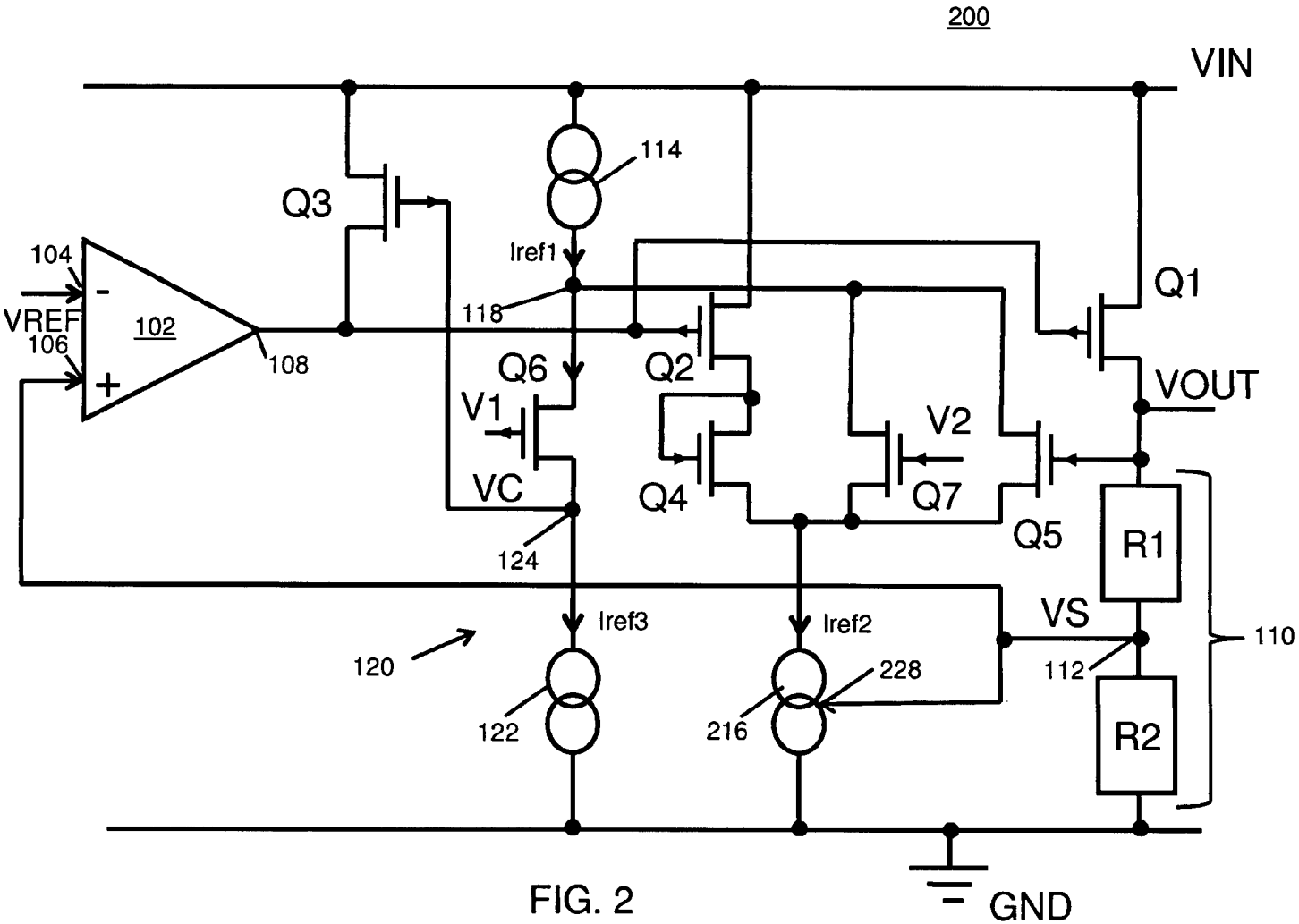
FIG. 2 is a schematic circuit diagram of a series regulator with an over current protection circuit in accordance with another embodiment of the present invention.

Referring now to FIG. 2, a series regulator with an over current protection circuit 200 in accordance with another embodiment of the present invention is shown. The circuit 200 mainly has the same circuitry as the circuit 100 with some additional components and the second constant current source 116 is modified to perform as a controllable constant current source 216. As most of the circuitry has been described above with reference to FIG. 1, a repetitive description of this circuitry is not required for one of skill in the art to understand the invention and only the additional circuitry and the controllable constant current source 216 will be described. In this embodiment the second constant current source is a controllable constant current source 216 having a current source control input 228 coupled to the attenuator output 112.

There is a short current limit transistor Q7 coupled across differential transistor pair. The short current limit transistor Q7 has a control electrode (gate) coupled to a reference voltage V2 selected to bias the short current limit transistor Q7 into a conductive state when the output voltage at the output terminal VOUT falls below a voltage that biases the gate of second differential transistor Q5 to a non-conductive state. As illustrated, in the above embodiments transistors Q1, Q2 and Q6 are PMOS transistors, whereas all other transistors are NMOS transistors.

In normal load conditions, both circuits 100,200 provide an error signal at the differential amplifier output 108 whose value is a function of the difference between a proportion of the output voltage VO and VREF. This error signal at the differential amplifier output 108 controls current flow through the output transistor Q1 under normal load conditions.

Figure 3:
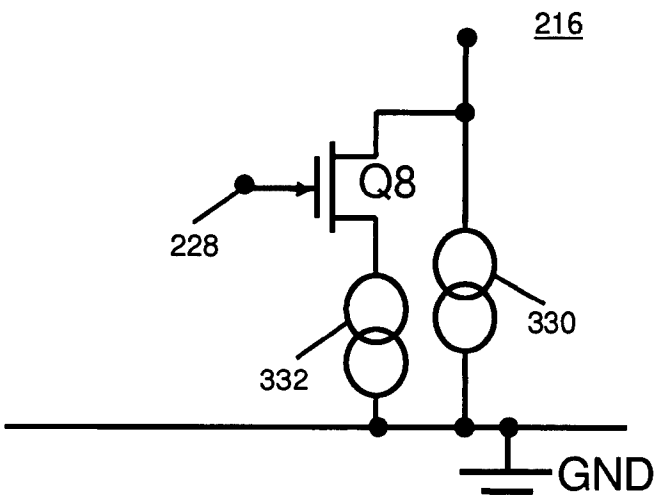
FIG. 3 is a schematic circuit diagram of an embodiment of a controllable constant current source for the circuit of FIG. 2.

Referring to FIG. 3 there is illustrated an embodiment of the controllable constant current source 216 that includes a current source control transistor Q8 with a control electrode (gate), this control electrode is the current source control input 228 that is coupled to the attenuator output 112. The controllable constant current source 216 also has a directly coupled current source 330 coupling the power supply reference terminal GND to the differential transistor pair comprising the first and second differential transistors Q4,Q5. Further, there is a selectable coupled current source 332 coupled to the power supply reference terminal GND and coupled to the differential transistor pair through the current source control transistor Q8.

Figure 4:
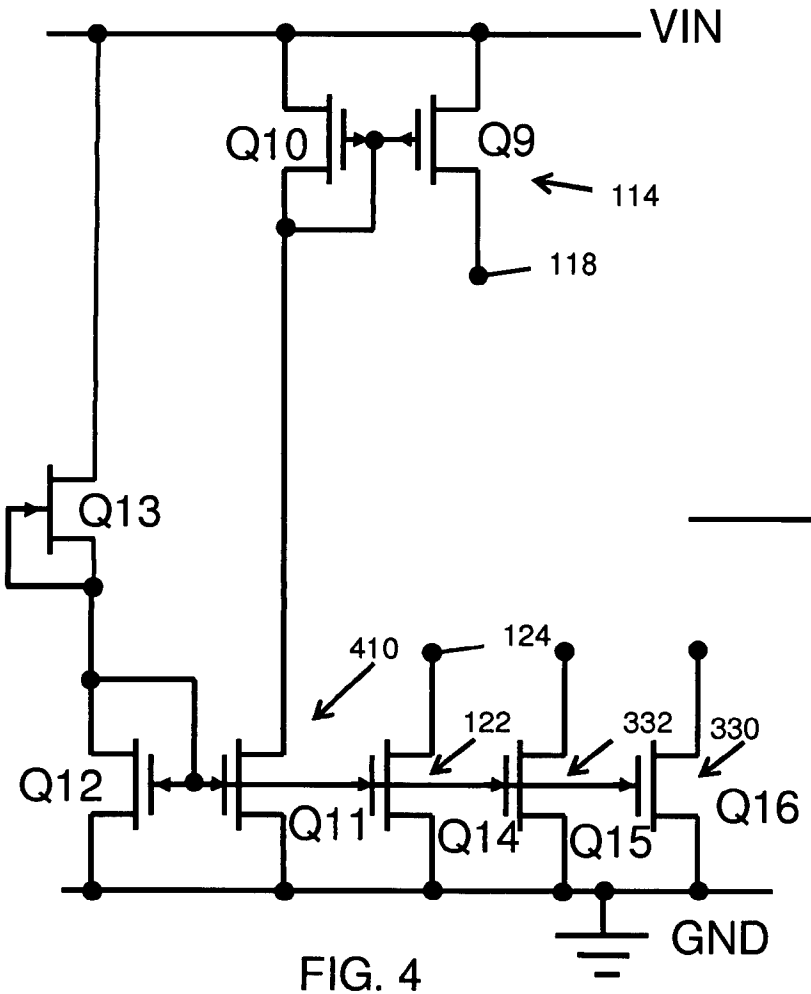
FIG. 4 is a schematic circuit diagram of an embodiment of an implementation of current sources of FIGS. 1 and 2.

In FIG. 4 there is illustrated an embodiment of the implementation of the current sources of FIGS. 1 and 2. As shown the first constant current source 114 includes a first current mirror comprising two PMOS Transistors Q9, Q10 with their gates coupled together. The drain of Field Effect Transistor Q9 provides the current source output 118 and the drain of Transistor Q10 is coupled to the power supply reference terminal GND through a transistor Q11 of a second current mirror 410. The second current mirror 410 also has transistor Q12 coupling both a gate and a source of a primary constant current source transistor Q13 to the power supply reference terminal GND. The drain of the primary constant current source transistor Q13 is connected to the input power supply terminal VIN and both gates of transistors Q11 and Q12 are coupled to the source of the primary constant current source transistor Q13.

There are three further constant current source transistors Q14, Q15, Q16 with their sources connected to the power supply reference terminal GND and their gates connected to the source of the primary constant current source transistor Q13. The constant current source transistor Q14 provides the third constant current source 122 and therefore the drain of the constant current source transistor Q14 is connected to the converter output 124. Also, the constant current source transistor Q15, Q16 provide the selectable coupled current source 332 and the directly coupled current source 330. As will be apparent one of skill in the art, the second constant current source 116 can also be a transistor configured just like either of constant current source transistor Q15, Q16.

Figure 5:
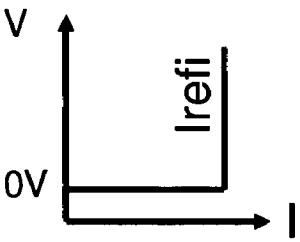
FIG. 5 is a voltage versus current graph for reference currents for the circuits of FIGS. 1 and 2.

Referring now to FIG. 5 there is illustrated a voltage versus current graph of a reference current for the series regulator with an over current protection circuit 100 or series regulator with an over current protection circuit 200. More particularly, FIG. 5 shows the voltage versus current characteristic of the first, second and third constant current sources 114, 116, 122. As illustrated, when the current through a constant current source is zero then a voltage across the constant current source is also 0. As the current through a constant current source increases the voltage across the constant current source remains 0 until a current threshold value is reached. This current threshold value is the Irefi, where i is an integer of 1 to 3 indicating the constant currents Iref1, Iref2, Iref3 associated respectively with the first to third current sources 114, 116, 122. As shown, when the current threshold value is reached, the current cannot increase past Irefi and the voltage across the respective constant current source is constant at a value above zero volts.

Figure 6:
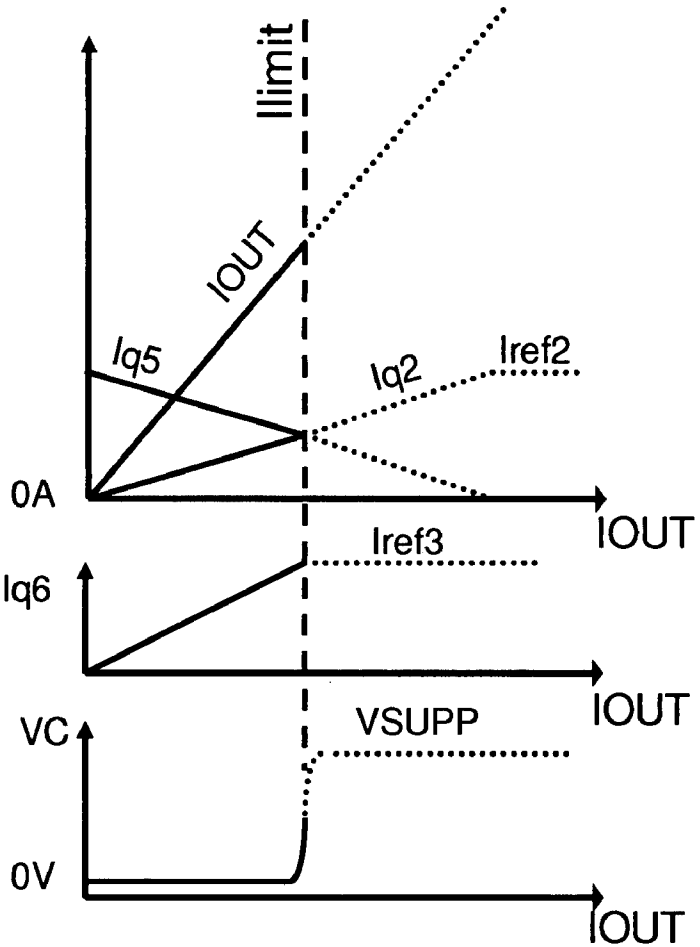
FIG. 6 illustrates graphs showing voltage and current flow relationships for the circuits of FIGS. 1 and 2.

Referring to FIG. 6, there is illustrated graphs showing voltage and current flow relationships for the series regulator with an over current protection circuit 100 or series regulator with an over current protection circuit 200 (with the short current limit transistor Q7 in a non-conductive state). In operation, the current sense transistor Q2 controls the conductivity of the second differential transistor Q5 thereby varying a control current Iq6, flowing through the cascode transistor Q6, that is supplied from the first constant current source 114 to the current to voltage converter 120. More specifically, and as illustrated, as the load current IOUT at the output terminal VOUT increases, a sense current Iq2 flowing through the current sense transistor Q2 increases. Consequently, a current Iq5 flowing through the second differential transistor Q5 decreases since the constant current Iref2=Iq5+Iq2. Furthermore, since then constant current Iref1=Iq6+Iq5, then the control current Iq6 increases as the load current IOUT increases.

When the control current Iq6 matches (reaches) a current limiting threshold value (Iref3), the Voltage control signal VC at the converter output 124 transitions rapidly from zero volts to approximately the supply voltage VSUPP thereby changing the state of the current limiting transistor Q3 from a non-conducting state to a conducting state. As a result, a control voltage at the gate of the output transistor Q1 increases thereby limiting current flow through the output transistor Q1. Consequently, when the control current Iq6 (matches) reaches the current limiting threshold value (Iref3), the voltage control signal VC at the converter output 124 controls the current limiting transistor Q3 to thereby limit the maximum current flow through the output transistor Q1 to a limiting current value Ilimit.

In this embodiment, the current limiting threshold value (Iref3) is chosen by suitable biasing and selection of constant currents Iref1 to Iref3 such that Iref1=Iref2=2*Iref3. Hence, when Iq5=Iq2 then Iq6=Iref3.

Figure 7:
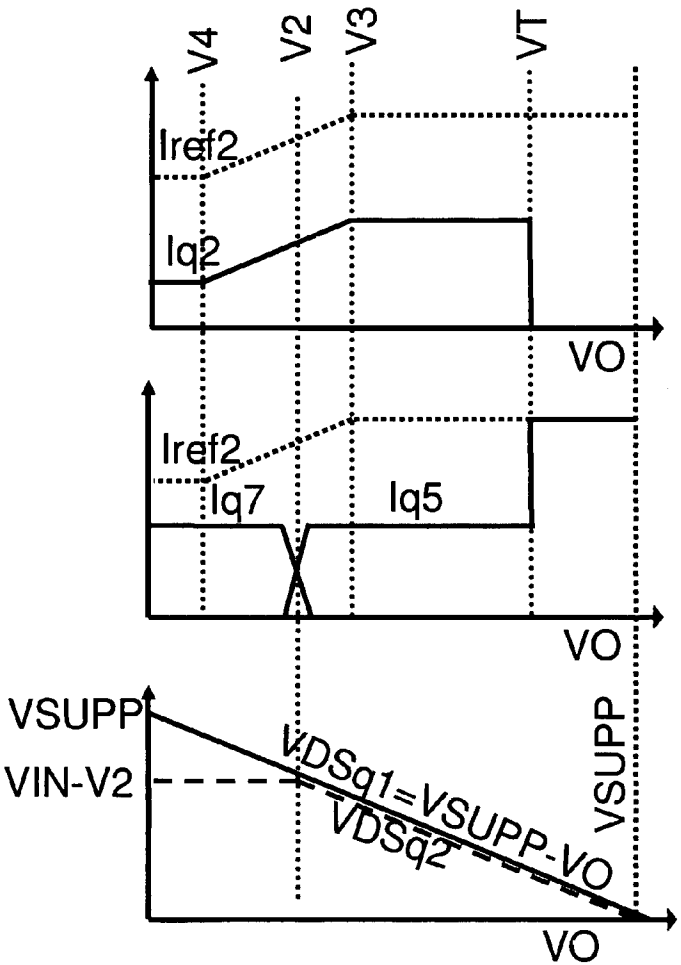
FIG. 7 illustrates graphs for additional voltage and current flow relationships for circuit of FIG. 2.

Referring to FIG. 7, there are graphs showing additional voltage and current flow relationships for the series regulator with an over current protection circuit 200. As shown, when no current flows through the output transistor Q1 the output voltage VO at the output terminal VOUT is equal to the input voltage (supply voltage) VSUPP. As the output voltage VO at the output terminal VOUT decreases to a threshold value VT, because of a voltage drop across the output transistor Q1 due to loading at the output terminal VOUT, the sense current Iq2 steps immediately up to a maximum value. At this point, and for the output voltage VO range between VT and zero volts, Iq7+Iq5=Iref1−Iref3=a constant current K, where Iq5 is a current flowing through the short current limit transistor Q7.

As the output voltage VO falls below a threshold value V3, the current source control transistor Q8 starts to switch off the selectable coupled current source 332. This is because the voltage signal VS has dropped below the minimum gate voltage required to maintain the current source control transistor Q8 in a fully conductive state. Consequently, the value of the constant current Iref2 through controllable constant current source 216 reduces and Iq2 starts to decrease (Iq7+Iq5=Iref1−Iref3=constant current K). Since Iq2 decreases, then the gate to source voltage across the current sense transistor Q2 decreases. This results in the gate to source voltage across the output transistor Q1 also decreasing (the load current IOUT is proportional to Iq2) and thus the load current IOUT decreases.

As the output voltage VO at the output terminal VOUT continues to decrease and approaches the reference voltage V2, the conductivity of the second differential transistor Q5 decreases and the conductivity of the short current limit transistor Q7 increases thereby maintaining Iq5+Iq7 at the constant current k=Iref1−Iref3. As the output voltage VO at the output terminal VOUT decreases further and falls below the reference voltage V2 the second differential transistor Q5 is in a fully non conducting state and the current limit transistor Q7 is in a fully conductive state (saturated state).

When the voltage output VO drops to a threshold value V4, the current source control transistor Q8 has switched off the selectable coupled current source 332 and the constant current Iref2 is equal to the current flowing through the directly coupled current source 330. Thus, the controllable constant current source 216 provides for a reduced constant current Iref2 and the current Iq2 has been reduced to a minimum value equal to Iref2−constant current k where Iq5+Iq7=constant current k; and Iq5=0 at the threshold value V4. Consequently, the gate to source voltage across the output transistor Q1 also decreases to a minimum (the load current IOUT is proportional to Iq2) and thus the load current IOUT decreases to a value Ishort for load resistance is approaching a short circuit. Hence, the reduced constant current Iref2 reduces the sense current Iq2 flowing through the current sense transistor Q2 thereby resulting in reducing the current flow through the output transistor to the value Ishort.

Figure 8:
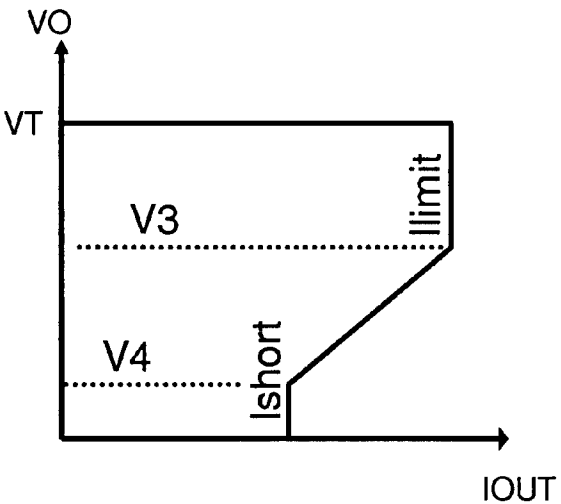
FIG. 8 illustrates a graph showing a relationship between load voltage and load current for the circuit of FIG. 2.

In FIG. 8, there is illustrated a graph showing the relationship between the load voltage VO and load current IOUT at the output terminal VOUT for the series regulator with an over current protection circuit 200.

As shown, the load voltage or output voltage VO is constant for a load current IOUT up to Ilimit (when Iq6=IREF3). The load voltage VO can then vary (for variations in load resistance whilst the load current is constant at Ilimit. However, if the load resistance decreases so that the load resistance is approaching a short, then the output voltage VO will be between the threshold value V3 and threshold value V4 and both the output voltage VO and load current IOUT decrease proportionally relative to each other. Finally, when the load resistance is essential a short (or very low resistance), the load current is constant at Ishort and the output voltage VO can vary between V4 and zero volts.

Figure 9:
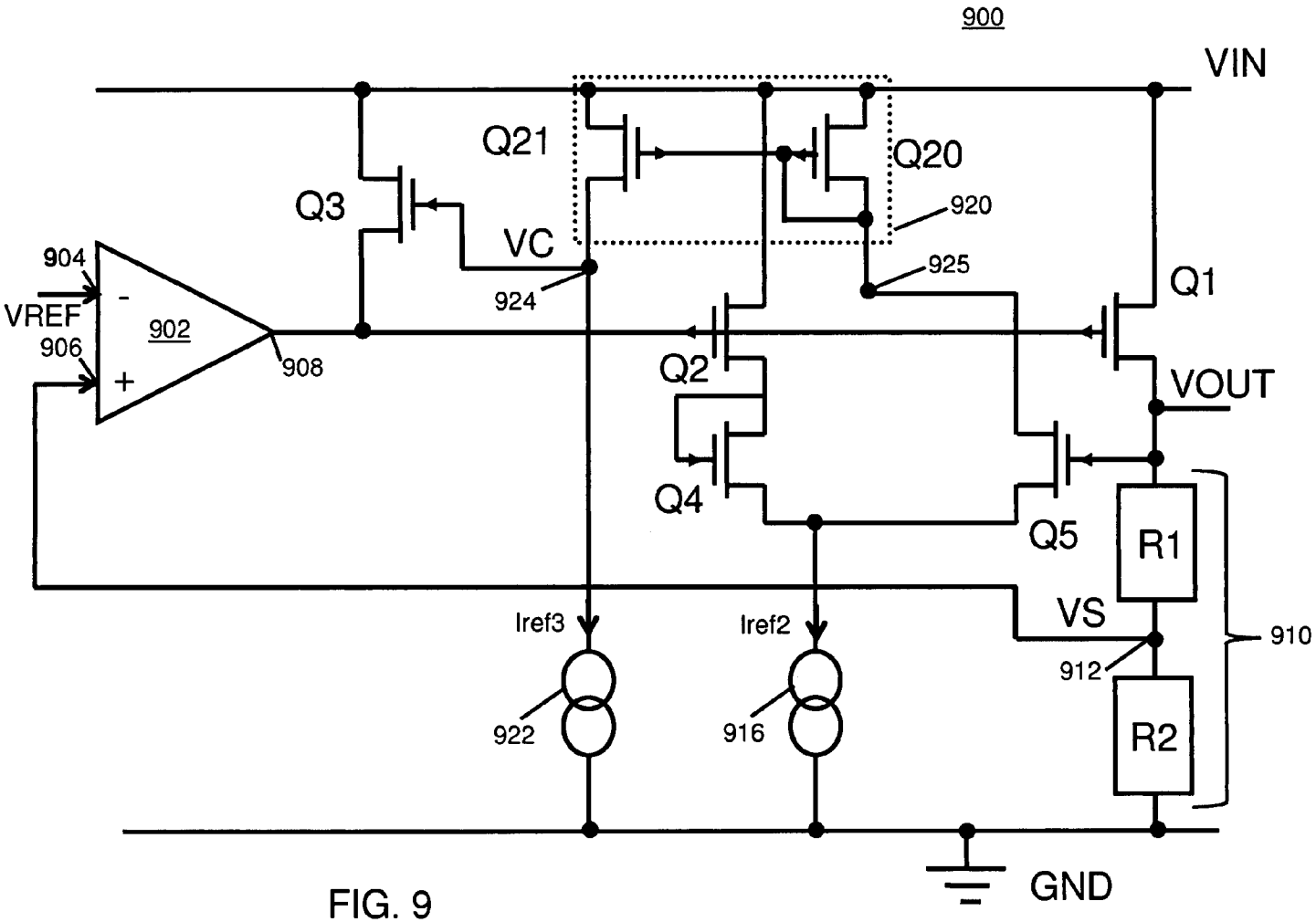
FIG. 9 is a schematic circuit diagram of a series regulator with an over current protection circuit in accordance with another embodiment of the present invention.

Referring now to FIG. 9, a series regulator 900 with an over current protection circuit in accordance with another embodiment of the present invention is shown. In normal operation the series regulator 900 receives the input voltage VSUPP at an input power supply terminal VIN and generates the output voltage VO and an output or load current IOUT at an output terminal VOUT. The series regulator 900 comprises a differential amplifier 902 having an inverting input 904 that receives a reference voltage VREF, a non-inverting input 906 and a differential amplifier output 908. An output transistor Q1 is connected between the input power supply terminal VIN and the output terminal VOUT, and a control electrode (gate) of the output transistor Q1 is connected to the differential amplifier output 908.

There is a current sense transistor Q2 with a source electrode connected to the input power supply terminal VIN, and a control electrode (gate) connected to the differential amplifier output 908. In operation, the conductivity of the current sense transistor Q2 is dependent on the conductivity of the output transistor Q1 and therefore current flow through the output transistor Q1 is proportional to current flow through the current sense transistor Q2. Typically, the output transistor Q1 conducts between 100 to 1,000 times more current than the current sense transistor Q2.

The series regulator with an over current protection circuit 900 also has current limiting transistor Q3 connected between the input power supply terminal VIN and the differential amplifier output 908. An attenuator circuit 910 is connected between the output terminal VOUT and a power supply reference terminal GND. Again, in this embodiment, the power supply reference terminal GND is at ground potential, however, other potentials including both positive and negative potentials could also be used in other embodiments.

In this embodiment the attenuator circuit 910 is voltage divider with two series connected resistors R1,R2 (typically each being 10K Ohms in resistance) with a common node providing an attenuator output 912 connected to the non-inverting input 906 of the differential amplifier 902. In operation, the attenuator output 912 provides a voltage signal VS to the non-inverting input 906 that is proportional to the output voltage VO at the output terminal VOUT.

There is a current mirror 914 having an input connected to the input power supply terminal VIN. The current mirror has two current supplying outputs 924,925. A first constant current source 916, associated with a constant current Iref2 with a first node is connected to the power supply reference GND. There is also a second constant current source 922 with a first node connected to the power supply reference terminal GND and a second node connected to both the first one of the current supplying outputs 924 of the current mirror 914 and the control electrode (gate) of the current limiting transistor Q3. In operation, the first one of the current supplying outputs 924 generates a voltage control signal VC that controls the conductive state of the current limiting transistor Q3.

The series regulator 900 also has a differential transistor pair comprising a first differential transistor Q4 and a second differential transistor Q5. A control electrode (gate) of the first differential transistor Q4 is coupled to a drain electrode of the current sense transistor Q2 and the first differential transistor Q4 couples the current sense transistor Q2 to the first constant current source 916. The second differential transistor Q5 has a control electrode coupled to the output terminal VOUT and the second differential transistor Q5 couples a second one of the two current supplying outputs 925 of the current mirror 914 to the first constant current source 916. As will be apparent to one of skill in the art, the second one of the two current supplying outputs 925 can also be considered as a control input. This is because the current flowing out of the second one of the two current supplying outputs 925 controls the corresponding mirror image current flowing out of the first one of the two current supplying outputs 924. However, in this specification the second one of the two current supplying outputs 925 is referred to as an output since it provides a current source.

Figure 10:
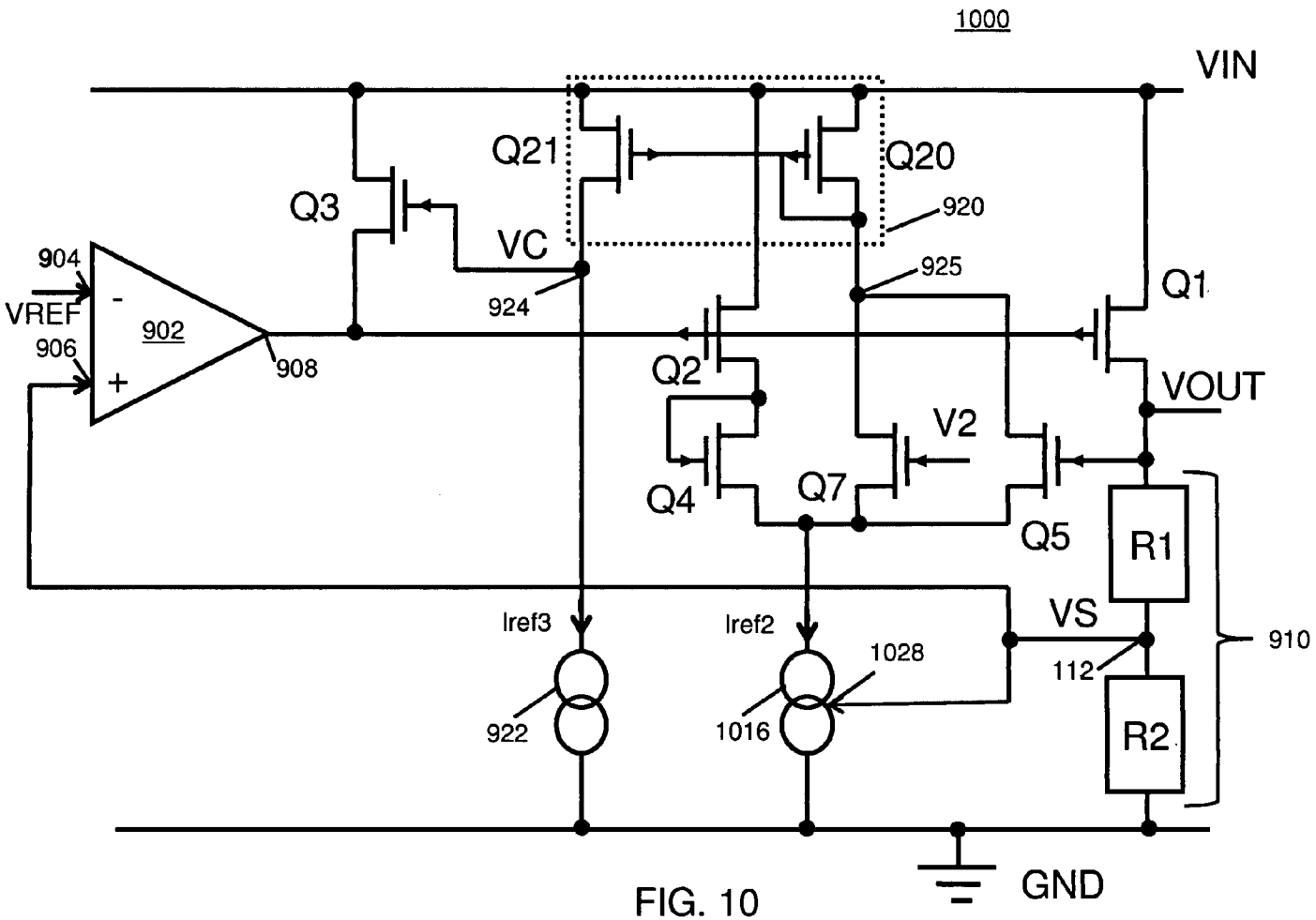
FIG. 10 is a schematic circuit diagram of a series regulator with an over current protection circuit in accordance with a further embodiment of the present invention.

Referring now to FIG. 10, a series regulator with an over current protection circuit 1000 with an over current protection circuit in accordance with another embodiment of the present invention is shown. The series regulator with an over current protection circuit 1000 mainly has the same circuitry as series regulator 900 with additional some additional components and the first constant current source 916 is modified to perform as a controllable constant current source 1016. As most of the circuitry been described above with reference to FIG. 9, a repetitive description of this circuitry is not required for one of skill in the art to understand the invention and only the additional circuitry and the controllable constant current source 1016 will be described. In this embodiment the first constant current source is a controllable constant current source 1016 having a current source control input 1028 coupled to the attenuator output 912.

There is a short current limit transistor Q7 coupled across differential transistor pair. The short current limit transistor Q7 has a control electrode (gate) coupled to a reference voltage V2 selected to bias the short current limit transistor Q7 into a conductive state when the output voltage at the output terminal VOUT falls below a voltage that biases the gate of second differential transistor Q5 to a non-conductive state. As illustrated, in the above embodiments of FIGS. 9 and 10, transistors Q1, Q2, Q3, Q20 and Q21 are PMOS transistors, whereas all other transistors are NMOS transistors.

In normal load conditions, both circuits 900, 1000 provide an error signal at the differential amplifier output 908 whose value is a function of the difference between a proportion of the output voltage VO and VREF. This error signal at the differential amplifier output 908 controls current flow through the output transistor Q1 under normal load conditions.

The controllable constant current source 1016 has been described above with reference to FIG. 3 and therefore to avoid repetition is not described again. Also, the first and second constant current sources 916, 922 are implemented with similar circuitry to that of FIG. 4 and will be apparent to a person of ordinary skill in the field. In operation, for both a series regulators with an over current protection circuit 900, 1000 the current sense transistor Q2 controls the conductivity of the second differential transistor Q5 thereby varying current supplied from the second one of the current supply outputs 925. As the current supplied from the second one of the current supply outputs 925 decreases, due to excessive loading at the output terminal VOUT, a control current supplied from the first one of the two current supplying outputs 924 also decreases by the same amount. When the control current matches (reaches) a limiting threshold value, the voltage control signal VC at the second one of the two current supplying outputs 924 transitions rapidly from approximately the input voltage (supply voltage) VSUPP to zero volts. As a result, the voltage control signal VC controls the current limiting transistor Q3 from a non-conducting state to a conducting state to thereby limit maximum current flow through the output transistor Q1 to a value Ilimit.

Referring specifically to the series regulator with an over current protection circuit 1000. As the output voltage VO at the output terminal VOUT decreases to a threshold value VT, because of a voltage drop across the output transistor Q1 due to loading at the output terminal VOUT, the sense current Iq2 flowing through the current sense transistor Q2 steps immediately up to a maximum value. When the output voltage VO falls below a threshold value V3, the current source control transistor Q8 starts to switch off the selectable coupled current source 1016. This is because the voltage signal VS has dropped below the minimum gate voltage required to maintain the current source control transistor Q8 in a fully conductive state. When VO falls below the threshold value V3 Iq5+Iq7=a constant current k and therefore the sense current Iq2 through the sense transistor Q2 decreases thereby decreasing the load current IOUT flowing through the output transistor. When the voltage output VO drops to a threshold value V4, the current source control transistor Q8 has switched off the selectable coupled current source 332 and the constant current Iref2 is equal to the current flowing through the directly coupled current source 330. Consequently, the sense current Iq2 through the sense transistor Q2 further decreases and gate to source voltage across the output transistor Q1 also decreases to a minimum (the load current IOUT is proportional to Iq2). The load current IOUT therefore decreases to a value Ishort for load resistance is approaching a short circuit. Hence, the reduced constant current Iref2 reduces the sense current Iq2 flowing through the current sense transistor Q2 thereby reducing the current flow through the output transistor to the value Ishort.

As will be apparent to one skilled in the art, series regulator with an over current protection circuits as described above can be summarized to include a differential amplifier having an inverting input that receives a reference voltage, a non-inverting input, and a differential amplifier output. The output transistor Q1 is connected between the input power supply terminal VIN and the output terminal VOUT and the control electrode of the output transistor Q1 is connected to the differential amplifier output. The current sense transistor Q2, with a source electrode connected to the input power supply terminal VIN and control electrode connected to the differential amplifier output, has a conductivity dependent on the conductivity of the output transistor Q1. The current limiting transistor Q3 is connected between the input power supply terminal VIN and the differential amplifier output. The attenuator circuit has an attenuator output connected to the non-inverting input of the differential amplifier, and the attenuator output provides a voltage signal VS proportional to the output voltage VO at the output terminal VOUT.

A current supply source (either the first constant current source 114 or current mirror 920) provides current to both a constant current source (second constant current source 116, 916) and a converter output of a current to voltage converter (124,924), the converter output being connected to a control electrode of the current limiting transistor Q3. The first differential transistor Q4 couples the current sense transistor Q2 to the constant current source (second constant current source 116,916). The second differential transistor Q5 couples the current supply source to the constant current source. Hence, in operation, the current sense transistor controls the conductivity of the second differential transistor thereby varying a control current supplied from the current supply source to the constant current source. When the control current matches (reaches) a limiting threshold value, a voltage control signal at the converter output controls the current limiting transistor to thereby limit current flow through the output transistor.

Typically, the supply voltage VSUPP can range from 3V to 40V. But more typically, supply voltage VSUPP can range from 3V to 9V for small hand held devices. As will be apparent to one skilled in the art, the regulators with an over current protection circuit 100, 200, 900 and 1000 may be implemented in any form of transistor technology such as Metal Oxide Semiconductor (MOS, using bipolar transistors or otherwise, as such throughout this specification the terms gate, source and drain can be readily substituted for base emitter and collector.

As is evident from the foregoing discussion, the present invention provides for a series regulator having an over current protection circuit. Reduced power consumption results when low resistance loads are connected to the output terminal VOUT. More specifically, when low resistance loads that approach a short circuit are a connected to the output terminal VOUT, the output transistor Q1 limits the maximum load current to Ilimit and when the load resistance approaches a short the output transistor Q1 reduces the load current to Ishort.

The description of the preferred embodiments of the present invention has been presented for purposes of illustration and description, but is not intended to be exhaustive or to limit the invention to the forms disclosed. It will be appreciated by those skilled in the art that changes could be made to the embodiments described above without departing from the broad inventive concept thereof. It is understood, therefore, that this invention is not limited to the particular embodiment disclosed, but covers modifications within the spirit and scope of the present invention as defined by the appended claims.

The invention claimed is:

1. A series regulator with an over current protection circuit, wherein the series regulator receives an input voltage at an input power supply terminal and generates an output voltage and an output current at an output terminal, the series regulator comprising:

a differential amplifier having an inverting input that receives a reference voltage, a non-inverting input, and a differential amplifier output;

an output transistor connected between the input power supply terminal and the output terminal, wherein a control electrode of the output transistor is connected to the differential amplifier output;

a current sense transistor having a source electrode connected to the input power supply terminal, and a control electrode connected to the differential amplifier output, wherein the conductivity of the current sense transistor is dependent on the conductivity of the output transistor;

a current limiting transistor connected between the input power supply terminal and the differential amplifier output;

an attenuator circuit connected between the output terminal and a power supply reference terminal, the attenuator circuit having an attenuator output connected to the non-inverting input of the differential amplifier, the attenuator output providing a voltage signal proportional to the output voltage at the output terminal;

a first constant current source connected to the input power supply terminal;

a second constant current source connected to the power supply reference terminal;

a differential transistor pair comprising a first differential transistor with a control electrode coupled to a drain electrode of the current sense transistor, the first differential transistor coupling the current sense transistor to the second constant current source, the differential transistor pair comprising a second differential transistor with a control electrode coupled to the output terminal, the second differential transistor coupling an output of the first constant current source to the second constant current source; and a current to voltage converter coupling the output of first constant current source to the power supply reference terminal, the current to voltage converter having a converter output coupled to a control electrode of the current limiting transistor, wherein, in operation, the current sense transistor controls the conductivity of the second differential transistor thereby varying a control current supplied from the first constant current source to the current to voltage converter, and wherein when the control current matches a limiting threshold value, a voltage control signal at the converter output controls the current limiting transistor to thereby limit maximum current flow through the output transistor.

2. The series regulator of claim 1, wherein the current to voltage converter comprises a cascode transistor series coupled to a third constant current source, the third constant current source being connected to the power supply reference terminal and the cascode transistor being connected to the output of the first constant current source, and wherein the converter output is provided by a common node of the cascode transistor and third constant current source.

3. The series regulator of claim 1, wherein the attenuator circuit includes a voltage divider with at least two series connected resistors with a common node providing the attenuator output.

4. The series regulator of claim 1, wherein the second constant current source is a controllable constant current source having a current source control input coupled to the attenuator output.

5. The series regulator of claim 4, wherein the controllable constant current source includes:

a current source control transistor with a control electrode coupled to the attenuator output;

a directly coupled current source coupling the power supply reference terminal to the differential transistor pair; and a selectable coupled current source coupled to the power supply reference terminal and coupled to the differential transistor pair through the current source control transistor.

6. The series regulator of claim 5, wherein when the output voltage at the output terminal falls below the limiting threshold value, the controllable constant current source provides a reduced constant current flowing through the short current limit transistor, the reduced constant current being dependent on the voltage signal at the attenuator output.

7. The series regulator of claim 6, wherein there is a short current limit transistor coupled across the differential transistor pair.

8. The series regulator of claim 7, wherein the short current limit transistor has a control electrode coupled to a reference voltage, the short current limit reference voltage being selected to bias the short current limit transistor into a conductive state when the output voltage at the output terminal is below the limiting threshold value that biases the second differential transistor to a non-conductive state.

9. The series regulator of claim 8, wherein the reduced constant current reduces a sense current flowing through the current sense transistor thereby reducing the current flow through the output transistor.

10. A series regulator with an over current protection circuit, wherein the series regulator receives an input voltage at an input power supply terminal and generates an output voltage and an output current at an output terminal, the series regulator comprising:

a differential amplifier having an inverting input that receives a reference voltage, a non-inverting input, and a differential amplifier output;

an output transistor connected between the input power supply terminal and the output terminal, wherein a control electrode of the output transistor is connected to the differential amplifier output;

a current sense transistor having a source electrode connected to the input power supply terminal, and a control electrode connected to the differential amplifier output, wherein the conductivity of the current sense transistor is dependent on the conductivity of the output transistor;

a current limiting transistor connected between the input power supply terminal and the differential amplifier output;

an attenuator circuit connected between the output terminal and a power supply reference terminal, the attenuator circuit having an attenuator output connected to the non-inverting input of the differential amplifier, the attenuator output providing a voltage signal proportional to the output voltage at the output terminal;

a current mirror having an input connected to the input power supply terminal, the current mirror having two current supplying outputs;

a first constant current source with a first node connected to the power supply reference;

a second constant current source with a first node connected to the power supply reference terminal and a second node connected to both the first one of the current supplying outputs of the current mirror and the control electrode of the current limiting transistor; and a differential transistor pair comprising a first differential transistor with a control electrode coupled to a drain electrode of the current sense transistor, the first differential transistor coupling the current sense transistor to the first constant current source, the differential transistor pair comprising a second differential transistor with a control electrode coupled to the output terminal, the second differential transistor coupling a second one of the two current supplying outputs of the current mirror to the second constant current source, wherein, in operation, the current sense transistor controls the conductivity of the second differential transistor thereby varying a control current supplied from the second one of the two current supplying outputs of the current mirror to the second constant current source, and wherein when the control current matches a limiting threshold value, a voltage control signal at the second one of the two current supplying outputs of the current mirror controls the current limiting transistor to thereby limit maximum current flow through the output transistor.

11. The series regulator of claim 10, wherein the attenuator circuit includes a voltage divider with at least two series connected resistors with a common node providing the attenuator output.

12. The series regulator of claim 10, wherein the first constant current source is a controllable constant current source having a current source control input coupled to the attenuator output.

13. The series regulator of claim 12, wherein the controllable constant current source includes:

a current source control transistor with a control electrode coupled to the attenuator output;

a directly coupled current source coupling the power supply reference terminal to the differential transistor pair; and a selectable coupled current source coupled to the power supply reference terminal and coupled to the differential transistor pair through the current source control transistor.

14. The series regulator of claim 13, wherein when the output voltage at the output terminal falls below a limiting threshold value, the controllable constant current source provides a reduced constant current flowing through the short current limit transistor, the reduced constant current being dependent on the voltage signal at the attenuator output.

15. The series regulator of claim 14, wherein there is a short current limit transistor coupled across differential transistor pair.

16. The series regulator of claim 15, wherein the short current limit transistor has a control electrode coupled to a reference voltage, the reference voltage being selected to bias the short current limit transistor into a conductive state when the output voltage at the output terminal falls below the limiting threshold value that biases the second differential transistor to a non-conductive state.

17. A series regulator with an over current protection circuit, wherein the series regulator receives an input voltage at an input power supply terminal and generates an output voltage and an output current at an output terminal, the series regulator comprising:

a differential amplifier having an inverting input that receives a reference voltage, a non-inverting input, and a differential amplifier output;

an output transistor connected between the input power supply terminal and the output terminal, wherein a control electrode of the output transistor is connected to the differential amplifier output;

a current sense transistor having a source electrode connected to the input power supply terminal, and a control electrode connected to the differential amplifier output, wherein the conductivity of the current sense transistor is dependent on the conductivity of the output transistor;

a current limiting transistor connected between the input power supply terminal and the differential amplifier output;

an attenuator circuit connected between the output terminal and a power supply reference terminal, the attenuator circuit having an attenuator output connected to the non-inverting input of the differential amplifier, the attenuator output providing a voltage signal proportional to the output voltage at the output terminal;

a current supply source providing current to both a constant current source and a converter output of a current to voltage converter, the converter output being connected to a control electrode of the current limiting transistor; and a differential transistor pair comprising a first differential transistor with a control electrode coupled to a drain electrode of the current sense transistor, the first differential transistor coupling the current sense transistor to the constant current source, the differential transistor pair comprising a second differential transistor with a control electrode coupled to the output terminal, the second differential transistor coupling the current supply source to the constant current source, wherein, in operation, the current sense transistor controls the conductivity of the second differential transistor thereby varying a control current supplied from the current supply source to the constant current source, and wherein when the control current matches a limiting threshold value, a voltage control signal at the converter output controls the current limiting transistor to thereby limit maximum current flow through the output transistor.

18. The series regulator of claim 17, wherein the constant current source is a controllable constant current source having a current source control input coupled to the attenuator output.

19. The series regulator of claim 18, wherein the controllable constant current source includes:

a current source control transistor with a control electrode coupled to the attenuator output;

a directly coupled current source coupling the power supply reference terminal to the differential transistor pair; and a selectable coupled current source coupled to the power supply reference terminal and coupled to the differential transistor pair through the current source control transistor.

20. The series regulator of claim 19, wherein when the output voltage at the output terminal falls below a limiting threshold value, the controllable constant current source provides a reduced constant current flowing through the short current limit transistor, the reduced constant current being dependent on the voltage signal at the attenuator output.

* * * * *